US010594024B2

(12) United States Patent
Parkhurst et al.

(10) Patent No.: US 10,594,024 B2
(45) Date of Patent: Mar. 17, 2020

(54) HEAD-HAND CAPACITANCE COMPENSATION WITH DIGITAL VARIABLE CAPACITOR

(71) Applicant: CAVENDISH KINETICS, INC., San Jose, CA (US)

(72) Inventors: Ray Parkhurst, Santa Clara, CA (US); Paul Anthony Tornatta, Jr., Bend, OR (US)

(73) Assignee: CAVENDISH KINETICS, INC., San Jose, CA (US)

( * ) Notice: Subject to any disclaimer, the term of this patent is extended or adjusted under 35 U.S.C. 154(b) by 0 days.

(21) Appl. No.: 16/247,529

(22) Filed: Jan. 14, 2019

(65) Prior Publication Data

US 2019/0148818 A1 May 16, 2019

Related U.S. Application Data

(62) Division of application No. 15/301,277, filed as application No. PCT/US2015/024107 on Apr. 2, 2015, now Pat. No. 10,224,614.

(60) Provisional application No. 61/976,469, filed on Apr. 7, 2014.

(51) Int. Cl.

| | |
|---|---|
| ***H01Q 1/24*** | (2006.01) |
| ***H01Q 7/00*** | (2006.01) |
| ***H01Q 9/04*** | (2006.01) |
| ***H01Q 9/42*** | (2006.01) |
| ***H01Q 1/48*** | (2006.01) |

(52) U.S. Cl.

CPC ..... *H01Q 1/245* (2013.01); *H01Q 1/48* (2013.01); *H01Q 7/005* (2013.01); *H01Q 9/0421* (2013.01); *H01Q 9/42* (2013.01)

(58) Field of Classification Search

CPC ..... H01Q 1/245; H01Q 1/48; H01Q 9/42; H01Q 9/0421; H01Q 7/005

See application file for complete search history.

(56) References Cited

U.S. PATENT DOCUMENTS

2005/0057399 A1 3/2005 Kipnis et al.
2009/0284220 A1 11/2009 Toncich et al.

(Continued)

FOREIGN PATENT DOCUMENTS

CN 102761640 A 10/2012
CN 103138794 A 6/2013

OTHER PUBLICATIONS

PCT Notification of Transmittal of the International Search Report and the Written Opinion of the International Searching Authority for International Application No. PCT/US2015/024107; dated Jun. 29, 2015; 11 total pages.

(Continued)

*Primary Examiner* — Hoang V Nguyen
*Assistant Examiner* — Awat M Salih
(74) *Attorney, Agent, or Firm* — Patterson & Sheridan, LLP; Steven H. Versteeg

(57) ABSTRACT

The present disclosure generally relates to a device having a capacitance sensor that detects a change in capacitance that occurs in the antenna whenever the antenna is in close proximity to a user's hand and/or head. Following detection of the capacitance change, the capacitance of the antenna may be changed by using a variable capacitor that is coupled to the sensor through a controller.

18 Claims, 4 Drawing Sheets

(56) References Cited

U.S. PATENT DOCUMENTS

| | | | | |
|---|---|---|---|---|
| 2011/0012793 | A1* | 1/2011 | Amm | H01Q 1/243 343/702 |
| 2012/0003947 | A1 | 1/2012 | Su et al. | |
| 2012/0258772 | A1 | 10/2012 | Brogle et al. | |
| 2013/0127677 | A1 | 5/2013 | Lin et al. | |
| 2013/0130633 | A1 | 5/2013 | Lin et al. | |
| 2013/0207925 | A1 | 8/2013 | Ryshtun et al. | |
| 2013/0217342 | A1 | 8/2013 | Abdul-Gaffoor et al. | |
| 2014/0071008 | A1 | 3/2014 | Desclos et al. | |
| 2014/0087786 | A1 | 3/2014 | Tani et al. | |
| 2014/0187178 | A1* | 7/2014 | Yang | H01Q 9/06 455/77 |
| 2017/0250660 | A1 | 8/2017 | Parkhurst | |

OTHER PUBLICATIONS

European Patent Office; Examination Report for Application No. 15716687.7; dated Sep. 27, 2017; 6 total pages.
Office Action issued in corresponding Chinese Patent Application No. 201580023739.7, dated Jul. 23, 2018 (14 pages).
Search Report issued in corresponding Chinese Patent Application No. 2015800237397, dated Jul. 14, 2018 (4 pages).

* cited by examiner

HEAD-HAND CAPACITANCE COMPENSATION WITH DIGITAL VARIABLE CAPACITOR

CROSS-REFERENCE TO RELATED APPLICATIONS

This application is a divisional of co-pending U.S. patent application Ser. No. 15/301,277, filed Sep. 30, 2016, which application is a 371 of PCT/US2015/024107 filed Apr. 2, 2015, which application claims benefit of U.S. Provisional Patent Application Ser. No. 61/976,469, filed Apr. 7, 2014. Each of the aforementioned related patent applications is herein incorporated by reference.

BACKGROUND OF THE DISCLOSURE

Field of the Disclosure

Embodiments of the present disclosure generally relate to a device, such as a cell phone, with a feedback system that compensates for the capacitance change that occurs when a cell phone is held in the hand or adjacent the head of a user.

Description of the Related Art

Cellular phones, such as mobile phones, have many desirable features that make everyday life easier. For instance, mobile phone can receive emails, text messages and other data for the end user to utilize. Additionally, the mobile phone can send emails, text messages and other data from the mobile phone. The mobile phone typically operates on a wireless network provided by any one of the various cell phone carriers. The data sent to and from the mobile phones require the mobile phone to operate at an increasing number of frequencies to support all of the components and antennas of the mobile phone.

The issue with mobile phones is that when the phone is held in the hand or placed near the ear for talking, the head and hand can affect the device performance by interfering with the antenna. In fact, upon release of one mobile phone where antenna interference was a well documented problem, it was remarked that "You're holding it wrong" in regards to the mobile phone. In other words, simply by holding the phone, the antenna performance worsened. The antenna performance problem has continued to this day.

Therefore, there is a need in the art for a device and method whereby a user's hand and/or head does not negatively impact the device's performance.

SUMMARY OF THE DISCLOSURE

The present disclosure generally relates to a device having a capacitance sensor that detects a change in capacitance that occurs in the antenna whenever the antenna is in close proximity to a user's hand and/or head. Following detection of the capacitance change, the capacitance of the antenna may be changed by using a variable capacitor that is coupled to the sensor through a controller.

In one embodiment, a device comprises a first antenna; an RF source coupled to the first antenna; a capacitive sensor capable of detecting the capacitance of the antenna; a feedback controller coupled to the capacitive sensor; and a first capacitor coupled to the antenna and to the feedback controller.

In another embodiment, a method comprises detecting a change in capacitance of an antenna from a first capacitance to a second capacitance using a capacitive sensor that is disposed in a device; and changing capacitance in a first variable capacitor based upon feedback from the capacitive sensor, wherein changing capacitance in the first variable capacitor changes the capacitance of the antenna from the second capacitance to the first capacitance.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

The present disclosure generally relates to a device having a capacitance sensor that detects a change in capacitance that occurs in the antenna whenever the antenna is in close proximity to a user's hand and/or head. Following detection of the capacitance change, the capacitance of the antenna may be changed by using a variable capacitor that is coupled to the sensor through a controller.

Figure 1:
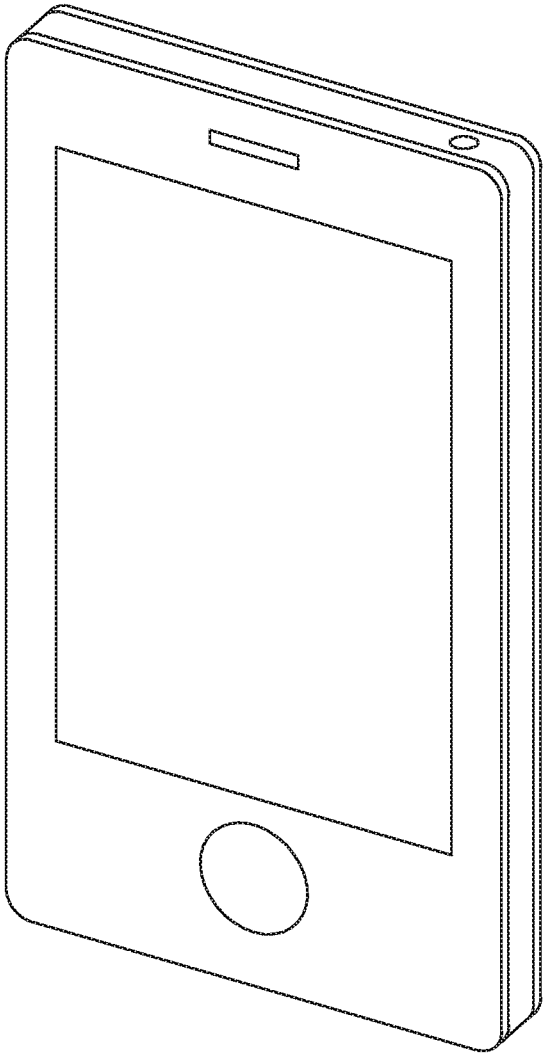
FIG. 1 is an isometric illustration of a mobile phone according to one embodiment.

Small antennas which are suitable to be integrated in a portable radio frequency device such as the mobile phone illustration in FIG. 1 are typically mounted on the top side or the back side of the mobile device, and the device acts as an active counter pole of the antenna. Such small antennas are typically designed as variations of simple monopole antenna, using forms such as (planar) inverted F antenna (P)IFA. The pattern of such antennas can be modified in order to adapt to the mechanical constraints of the device while maintaining its radiating characteristics.

Figure 2A:
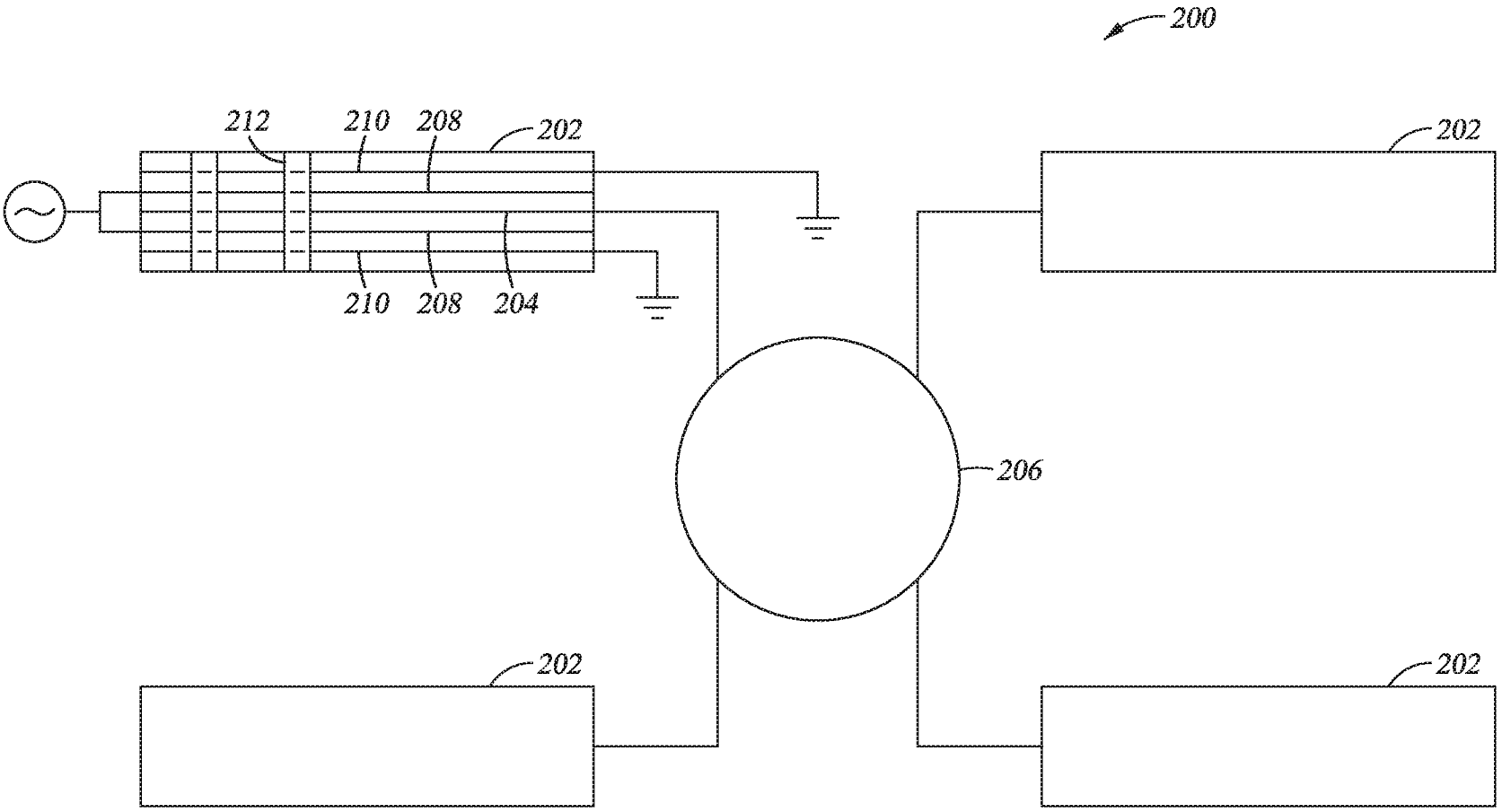
FIG. 2A is a schematic top illustration of a digital variable capacitor according to one embodiment.

FIG. 2A is a schematic illustration of a digital variable capacitor (DVC) 200 according to one embodiment. The DVC 200 includes a plurality of cavities 202. While only one cavity 202 is shown in detail, it is to be understood that each cavity 202 may have a similar configuration, although the capacitance for each cavity 202 may be different.

Each cavity 202 has a RF electrode 204 which is coupled to an RF connector/solder bump 206. Additionally, each cavity 202 has one or more pull-in electrodes 208 and one or more ground electrodes 210. The switching elements 212 (2 shown) are disposed over the electrodes 204, 208, 210. In fact, the switching elements 212 are electrically coupled to the ground electrodes 210. The switching elements 212 are movable to various spacing from the RF electrode 204 due to electrically current applied to the pull-in electrodes 208.

Figure 2B:
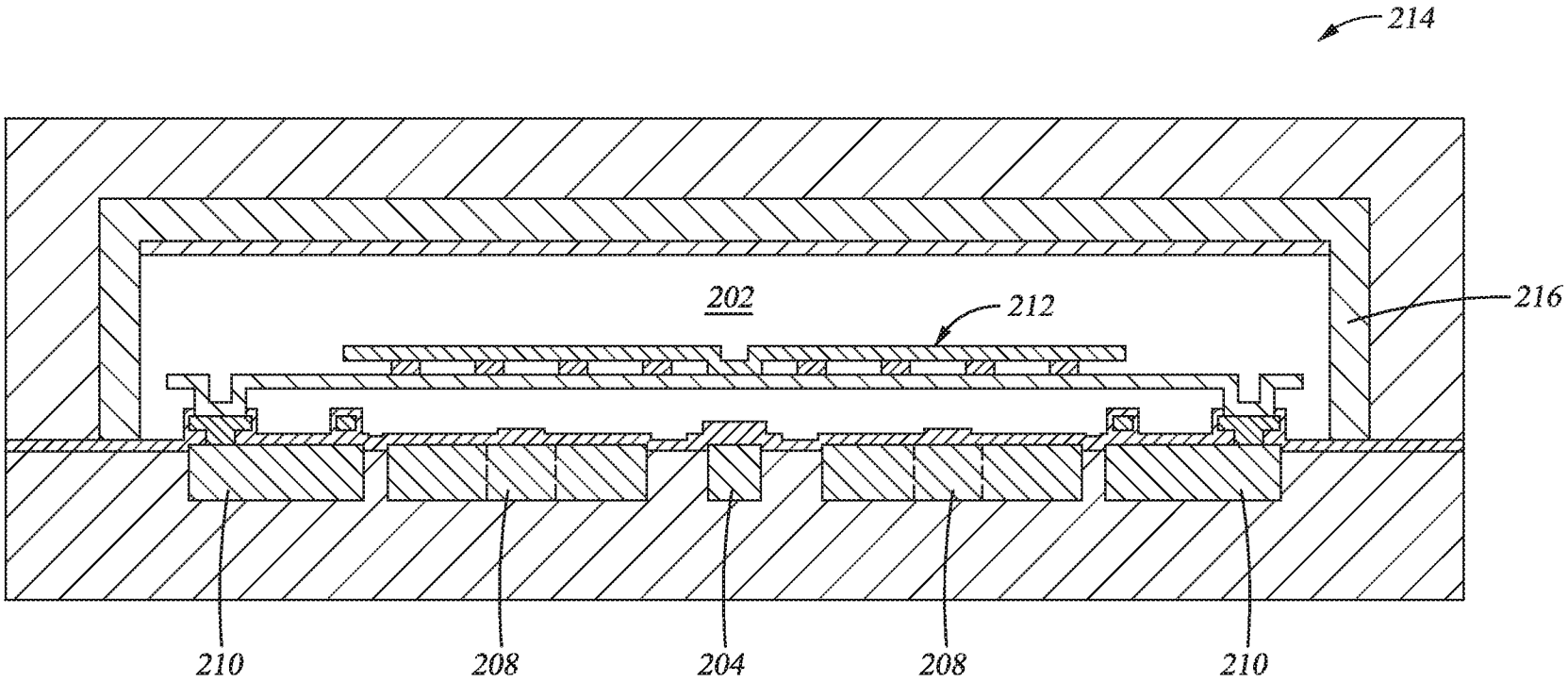
FIG. 2B is a schematic cross-sectional illustration taken along line A-A of FIG. 2A.

FIG. 2B is a schematic illustration of a MEMS device 214. The MEMS device 214 includes the electrodes 204, 208, 210 and the switching element 212 which is disposed in the cavity 200 and movable from a position close to the RF electrode 204 (referred to as the $C_{max}$ position) and a position spaced adjacent a pull-up electrode 216 (referred to as the $C_{min}$ position). The position of the switching elements 212 within the cavity 200 determines the capacitance for a particular cavity. By using the MEMS devices in a DVC, the antennas can be tuned as discussed herein.

Figure 3A:
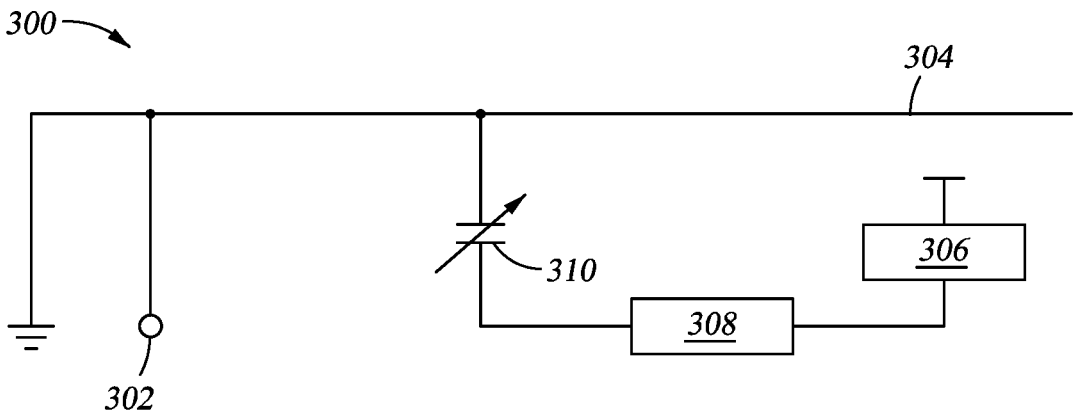
FIGS. 3A-3B are schematic circuit diagrams of the device capable of compensating for hand and/or head interference with antenna operation.
Figure 3B:
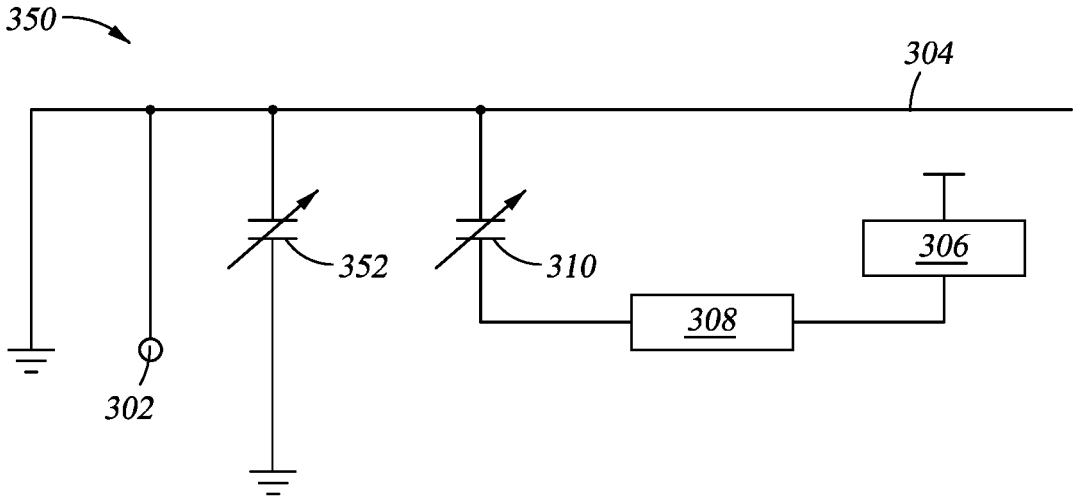

FIGS. 3A-3B are schematic circuit diagrams of a device having a capacitance feedback system according to embodiments of the disclosure. In FIG. 3A, the device 300 includes an RF feed 302 represented by a node that is connected to an antenna 304. The capacitance of the antenna 304 is measured by a capacitive sensor 306 that is coupled to a feedback controller 308 such as a digital signal processor (DSP). The controller 308 is coupled to a first variable capacitor 310 that is coupled to the antenna 304. In one embodiment, the first variable capacitor 310 is a DVC. In operation, the antenna 304 target capacitance is set to a free-space (without head or hand influence) level. When the device is picked up, the capacitance of the antenna 304 changes from the target capacitance level. The capacitance of the antenna 304 may be changed due to proximity to a user's head or by being picked up by the user and held in the user's hand.

It is to be understood that the capacitance of the antenna 304 may change multiple times due to initially being picked up by the hand of the user, then adjusted in the hand of the user, then placed against the ear of the user, and then moved as the user is talking on the mobile device. In other words, the capacitance of the antenna 304 may continuously change when the mobile device is in operation.

The sensor 306 detects the total capacitance of the antenna 304. The detected capacitance value is fed to the controller 308 which calculates the change from target capacitance and then adjusts the capacitance of capacitor 310 by a proportional amount. By adjusting the capacitance of capacitor 310, the total capacitance of the antenna 304 is changed back to the target capacitance level.

It is to be understood that the capacitance of the capacitor 310 may vary continuously due to the detected change in the capacitance of the antenna 304 changing continuously as the mobile device is in use.

In the embodiment shown in FIG. 3B, a second capacitor 352 is coupled to the antenna 304. The second capacitor may comprise a variable capacitor such as a DVC. In operation, the target capacitance value of the antenna 304 is adjusted when setting the capacitance of the second capacitor 352 for instance when a change in operating band of the antenna is desired. Then, when a user picks up the mobile device or places the device closer to the head of the user, the capacitance of the antenna 304 changes from the adjusted target capacitance, which includes the capacitance of the second capacitor 352, to a second capacitance due to the interference of the head and/or hand with the antenna. The sensor 306 then detects the change in capacitance of the antenna 304 from the adjusted target capacitance including the second capacitor 352. The controller 308 then changes the capacitance of the first capacitor 310 so that the antenna 304 total capacitance returns to the adjusted target value including the value of the second capacitor 352. If the value of the second capacitor 352 changes, for instance due to a change in operating band of the antenna, and hence, the capacitance of the antenna 304 changes from a first capacitance to a third capacitance, the controller 308 receives the information and further adjusts the target capacitance of the antenna 304. Then, when the user picks up the mobile device or moves the mobile device to a location close to the head of the user, the capacitance of the antenna 304 changes from the third capacitance to a fourth capacitance. The sensor 306 detects the capacitance of the antenna 304 and the controller 308 then changes the capacitance of the first capacitor 310 to thus change the capacitance of the antenna 304 to the third capacitance. It is to be noted that the second capacitor 352 operates independently of the first capacitor 310.

The embodiments discussed herein disclose a method and device for compensating for the capacitance change in the antenna that occurs whenever a user picks up a mobile device or moves a mobile device to close proximity to the user's head. Once the capacitance of the antenna changes, the change is detected and the new capacitance is compared to the target antenna capacitance. If the measured capacitance is different from the target capacitance, then a variable capacitor coupled to the antenna is adjusted to change the capacitance of the variable capacitor, which then changes the capacitance of the antenna back to the target capacitance. Based upon the embodiments discussed herein, a mobile device can operate properly when picked up by a user or moved closer to the user's head.

While the foregoing is directed to embodiments of the present disclosure, other and further embodiments of the disclosure may be devised without departing from the basic scope thereof, and the scope thereof is determined by the claims that follow.

The invention claimed is:

1. A device, comprising:

a first antenna;

an RF source coupled to the first antenna;

a capacitive sensor capable of detecting the capacitance of the antenna;

a feedback controller coupled to the capacitive sensor; and a first capacitor coupled to the antenna and to the feedback controller, wherein the antenna, the first capacitor, the feedback controller, and the capacitive sensor are connected in order in direct series connection.

2. The device of claim 1, wherein the first capacitor is a digital variable capacitor.

3. The device of claim 2, wherein the digital variable capacitor includes a plurality of MEMS devices.

4. The device of claim 3, wherein the antenna is coupled to ground.

5. The device of claim 4, further comprising a second capacitor coupled to the antenna.

6. The device of claim 5, wherein the second capacitor is a digital variable capacitor.

7. The device of claim 6, wherein the digital variable capacitor comprises a plurality of MEMS.

8. The device of claim 1, further comprising a second capacitor coupled to the antenna.

9. The device of claim 8, wherein the second capacitor is a digital variable capacitor that comprises a plurality of MEMS.

10. A device, comprising:

a first antenna;

an RF source coupled to the first antenna;

a capacitive sensor capable of detecting capacitance of the antenna, the capacitive sensor configured to detect a change of the capacitance of the antenna from a first capacitance;

a feedback controller coupled to the capacitive sensor; and a first variable capacitor coupled to the antenna and to the feedback controller, wherein the first variable capacitor, the feedback controller and the capacitive sensor are connected in series with the antenna and in that order from the antenna, and wherein the feedback controller is configured to continuously change the capacitance of the first variable capacitor in response to the change of the capacitance of the antenna so that the adjusted capacitance of the antenna returns to the first capacitance, wherein the antenna, the first variable capacitor, the feedback controller, and the capacitive sensor are connected in order in direct series connection.

11. The device of claim 10, wherein the first variable capacitor is a digital variable capacitor.

12. The device of claim 11, wherein the digital variable capacitor includes a plurality of MEMS devices.

13. The device of claim 12, wherein the antenna is coupled to ground.

14. The device of claim 12, further comprising a second capacitor coupled to the antenna.

15. The device of claim 14, wherein the second capacitor is a digital variable capacitor.

16. The device of claim 15, wherein the digital variable capacitor comprises a plurality of MEMS.

17. The device of claim 10, further comprising a second capacitor coupled to the antenna.

18. The device of claim 17, wherein the second capacitor is a digital variable capacitor that comprises a plurality of MEMS.

* * * * *